US005273230A

United States Patent [19]

Shaw et al.

[11] Patent Number: 5,273,230

[45] Date of Patent: Dec. 28, 1993

[54] DEVICE FOR ATTACHING A SHAFT IN A FRAME

[75] Inventors: Henry Shaw, Vleteren; Philippe Van Bogaert, Schaerbeek; Marcel Denoo, Langemark-Poelkapelle; Johan Pannekoucke, Ypres; Geert Ostyn, Roeselare, all of Belgium

[73] Assignee: Picanol N.V., naamloze vennootschap, Belgium

[21] Appl. No.: 804,636

[22] Filed: Dec. 11, 1991

Related U.S. Application Data

[63] Continuation of Ser. No. 570,420, Aug. 21, 1990, abandoned.

[30] Foreign Application Priority Data

Aug. 23, 1989 [BE] Belgium ..... 8900896
Jul. 26, 1990 [EP] European Pat. Off. ..... 90202048.6

[51] Int. Cl.[5] ..... B65H 19/30
[52] U.S. Cl. ..... 242/68.4
[58] Field of Search ..... 242/68, 68.1, 68.2, 242/68.3, 68.4, 129.6; 269/188, 228, 259 R; 139/97, 99, 304, 314; 384/24

[56] References Cited

U.S. PATENT DOCUMENTS 1,803,286 4/1931 Thatcher .
3,792,853 2/1974 Blatt ..... 269/228
3,831,926 8/1974 Sendoykas et al. ..... 269/228
3,884,274 5/1975 Sujdak ..... 139/97
3,981,509 9/1976 Myer ..... 242/68.4 X
4,141,543 2/1979 Kato ..... 269/228
4,243,468 1/1981 Boyd ..... 242/68 X
4,407,493 10/1983 Okolischan ..... 269/228 X
4,456,209 6/1984 Calizano et al. ..... 242/68.1
4,835,851 6/1989 Peel et al. ..... 269/126 X

FOREIGN PATENT DOCUMENTS 741028 5/1943 Fed. Rep. of Germany ..... 242/68
1098457 1/1961 Fed. Rep. of Germany .
2501319 7/1976 Fed. Rep. of Germany .
769302 3/1957 United Kingdom .

*Primary Examiner*—Daniel P. Stodola
*Assistant Examiner*—John P. Darling
*Attorney, Agent, or Firm*—Bacon & Thomas

[57] ABSTRACT

A device for attaching a shaft in a frame includes at least two supports for carrying the ends of the shaft, a support lock which keeps the shaft on its support while permitting the shaft to turn locally, and a hinged locking mechanism for closing and opening the lock. The lock is opened and closed automatically by the hinged locking mechanism, which causes the lock to open against a biasing force in response to insertion of the shaft.

21 Claims, 8 Drawing Sheets

6
34
36
33
30
31
41
42
40
5
32
7
4
1
9
38
11
37
22
3
39

34
6
31
42
41
40
36
33
30
5
32
7
38
11
4
1
9
37
22
3

DEVICE FOR ATTACHING A SHAFT IN A FRAME

This application is a continuation of application Ser. No. 07/570,420, filed Aug. 21, 1990, now abandoned.

BACKGROUND OF THE INVENTION

This invention concerns a device for attaching a shaft in a frame.

Generally, this invention is meant to be used in various applications, particularly to attach a beam in a weaving installation, either a warp beam or a cloth roll in a weaving machine, or a cloth roll in a separate take-up apparatus.

As is known, for the bearing of a cloth roll or warp beam, square shaft ends are used which act on square openings in the bearing. In order to apply the beam on the one hand and remove the beam on the other hand, it must be moved sideways, which is a cumbersome action.

Other devices, whereby the cloth roll or the warp beam are laid or rolled in a bearing shell, after which the bearing is closed by means of a bearing lid, are also applied frequently.

All these known devices have the disadvantage that they require additional interventions and that it is sometimes necessary that these interventions be performed by more than one person.

They also have the disadvantage that the operations require the use of tools.

It is particularly necessary for the automatic application and removal of the cloth roll that the number of operations to be performed remains limited, such that they can be performed by means of a simple mechanism.

The present invention concerns a device for attaching a shaft in a frame which does not have the above-mentioned disadvantages. More particularly, an objective of the invention is to provide a device to allow both the manual and automatic application of the shaft in the frame, whereby a lock is automatically provided in order to secure the shaft.

To this end, the invention concerns a device for attaching a shaft in a frame, including at least two supports to carry the shaft at its end on the one hand, at least at one support a lock which in its closed position keeps the shaft in place on its support while it can turn locally, and a hinged blocking mechanism for the lock. Preferably, the lock includes a rotatable arm which is attached to the frame in a turnable way, and which can be taken up to the shaft end of the above-mentioned shaft, while the hinged blocking mechanism is formed by two arms which form a toggle mechanism.

BRIEF DESCRIPTION OF THE DRAWINGS

In order to better explain the characteristics of the invention, by way of example only and without being limitative in any way, the following preferred embodiments are described with reference to the accompanying drawings, where.

DETAILED DESCRIPTION OF THE PREFERRED EMBODIMENTS

Figure 1:
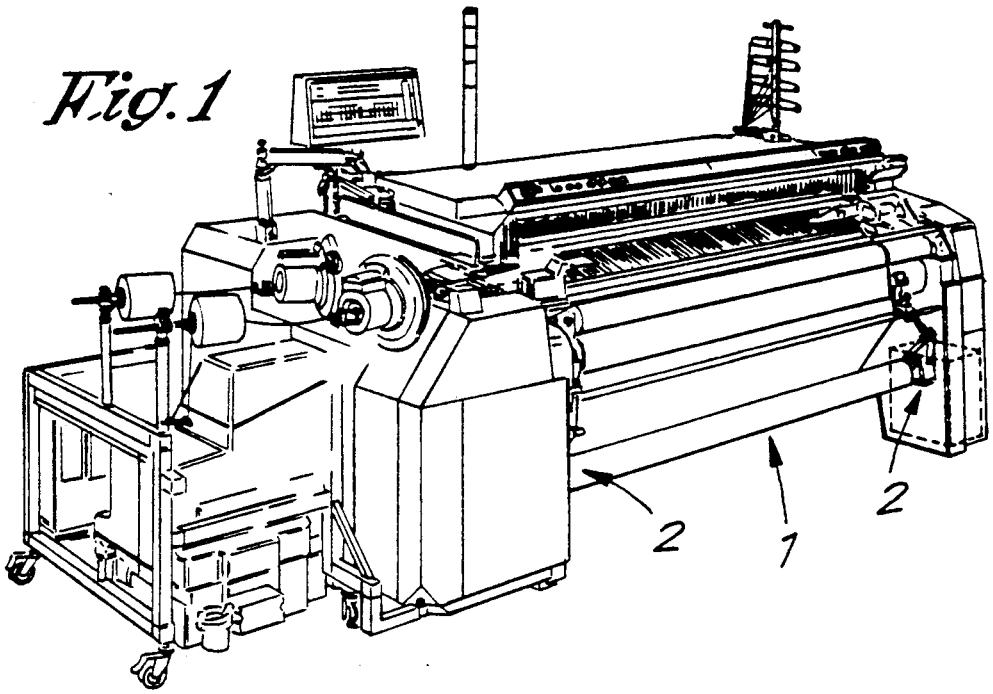
FIG. 1 shows a weaving machine which uses a device according to the invention for the attachment of the cloth roll.

FIG. 1 shows a schematic representation of a weaving machine, whereby, in order to attach removable shafts such as a cloth roll 1, devices 2 can be used as described below.

According to the invention, the above-mentioned devices 2 include, on the one hand, at least two supports 3, such as bearings, to carry the shaft 1 at its ends 4, and on the other hand, at least at the height of one support 3, a lock 5 which in its closed position keeps the shaft 1 in place on its support 3, and a hinged blocking mechanism 6 for the lock 5.

The lock 5 is formed by a rotatable arm, which is attached by means of a fulcrum 7 to a support 8, which is mounted on the frame 9 of the machine concerned or constructed in one part thereof. This rotatable arm is situated such that, when the shaft 1 is applied in the support 3, it can be taken up to the shaft end 4, thus preventing the shaft end 4 from leaving the support 3.

The support 3 is constructed in two parts and includes a bottom part 10 which is fixed to the frame 9, and a movable part 11 in the form of a lid, which is attached to the lock 5.

The hinged blocking mechanism 6 preferably includes two arms 12 and 13 which form a toggle mechanism, and which are mutually coupled to one another by means of a fulcrum 14. The arm 12, for that matter, is hinged to the support 8 by means of a fulcrum 15, while the arm 13 is also connected with the lock 5 by means of a fulcrum 16. The arms 12 and 13 are arranged such that the three fulcrums 14, 15 and 16 can at least be put in one line 17, to define a locked position of the toggle mechanism. This position is determined by a preferably adjustable stop 18 which is mounted on the support 8.

Figure 2:
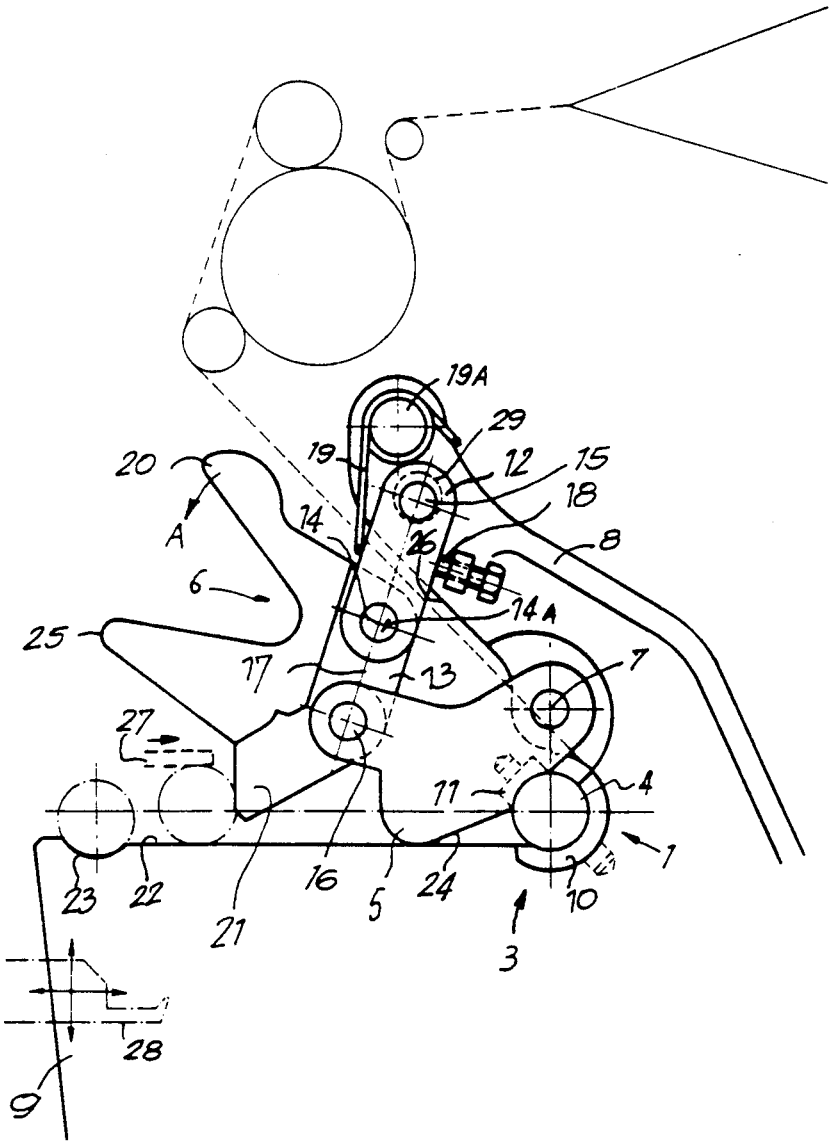
FIGS. 2, 3 and 4 show a device according to the invention in various positions.

The stop 18 may be placed, respectively set, such that the fulcrum between the arms 12 and 13 in its locked or toggled position is situated just off the line 17, particularly to its right, indicated by 14A in FIG. 2. This has the advantage that a stable position of the arms 12 and 13 is obtained.

The hinged blocking mechanism 6 can be folded together in the other direction, such that the lock 5 can be turned round the fulcrum 7 and the support 3 is consequently opened.

Preferably, the device is equipped with pressing means which force the hinged blocking mechanism 6 in the above-mentioned locked position, and which include, for example, a spring, such as a torsion spring 19, mounted round a shaft 19A on the support 8, and pressing against the arm 12 with a free end, such that the latter is forced against the stop 18.

The device preferably also has means which allow activation of the hinged blocking mechanism 6, in order to open the lock 5.

These means can in the first place include a handle 20 by which the blocking mechanism 6, particularly the arms 12 and 13, can be folded together, such that the lock 5 can be opened manually. The handle 20 preferably makes up part of the above-mentioned arm 13 and is at an angle in relation to the connection line between the fulcrums 14 and 16.

According to a variant, or possibly in combination with the description above, the means which allow activation of the hinged blocking mechanism 6 can also include an element which can be moved by means of a shaft 1 presented to the device, such that the lock 5 is opened.

In the embodiment shown, the above-mentioned element is formed by a protruding part 21 of the arm 13, such that this part 21 is situated above a supporting plane 22, over which the shaft 1 can be rolled to the bearing 3, and whereby the part 21 is situated in the path of the shaft 1.

The supporting plane 22 may have a recess 23 or similar, in which a shaft 1 can be placed in waiting position at its ends 4.

Preferably, the bottom side 24 of the locking element 5, in other words, the side which rests on the supporting plane 22, has a rounded form, such that the shaft end 4 can easily pass underneath the locking element 5.

The arm 13 preferably has a cam 25, whose aim will become apparent from the description below.

The working of the device can be easily deduced from the FIGS. 2 to 5.

FIG. 2 shows the device in rest position, whereby a shaft 1, such as a cloth roll, is placed in the support or bearing 3. The torsion spring 19 keeps the hinged blocking mechanism 6 in such a position that the fulcrums 14, 15 and 16 are situated in one line, or in a position whereby the middle fulcrum is situated at another place, indicated by 14A. As a result, the lock 5 cannot possibly be moved upward at the fulcrum 16, so that the support 3 remains closed.

Figure 3:
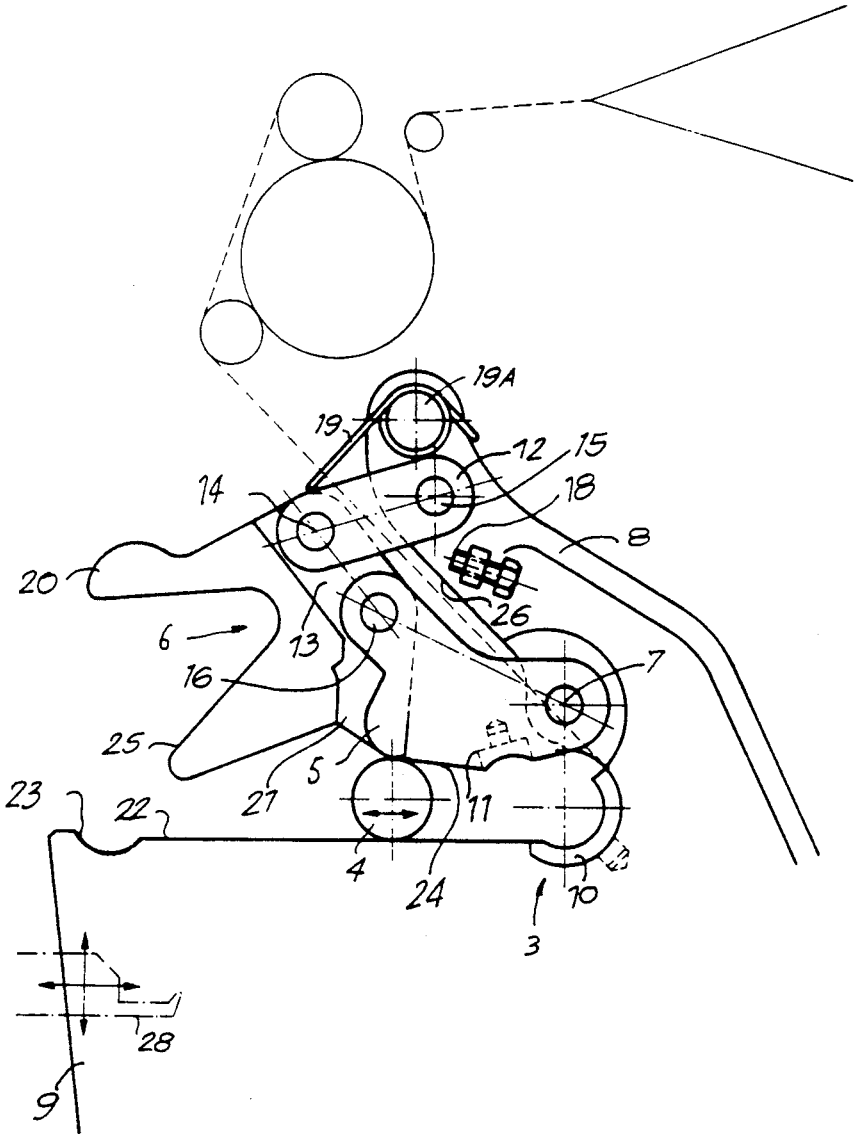

FIG. 3 shows the situtation when the shaft 1 is applied manually or automatically, whereby it must only be pushed over the supporting plane 22. The shaft first makes contact with the above-mentioned part 21, as shown by the dashed line in FIG. 2, such that the blocking mechanism 6 and the lock 5 are opened, and the shaft 1 can be slid in the supports 3 unhindered.

Figure 4:
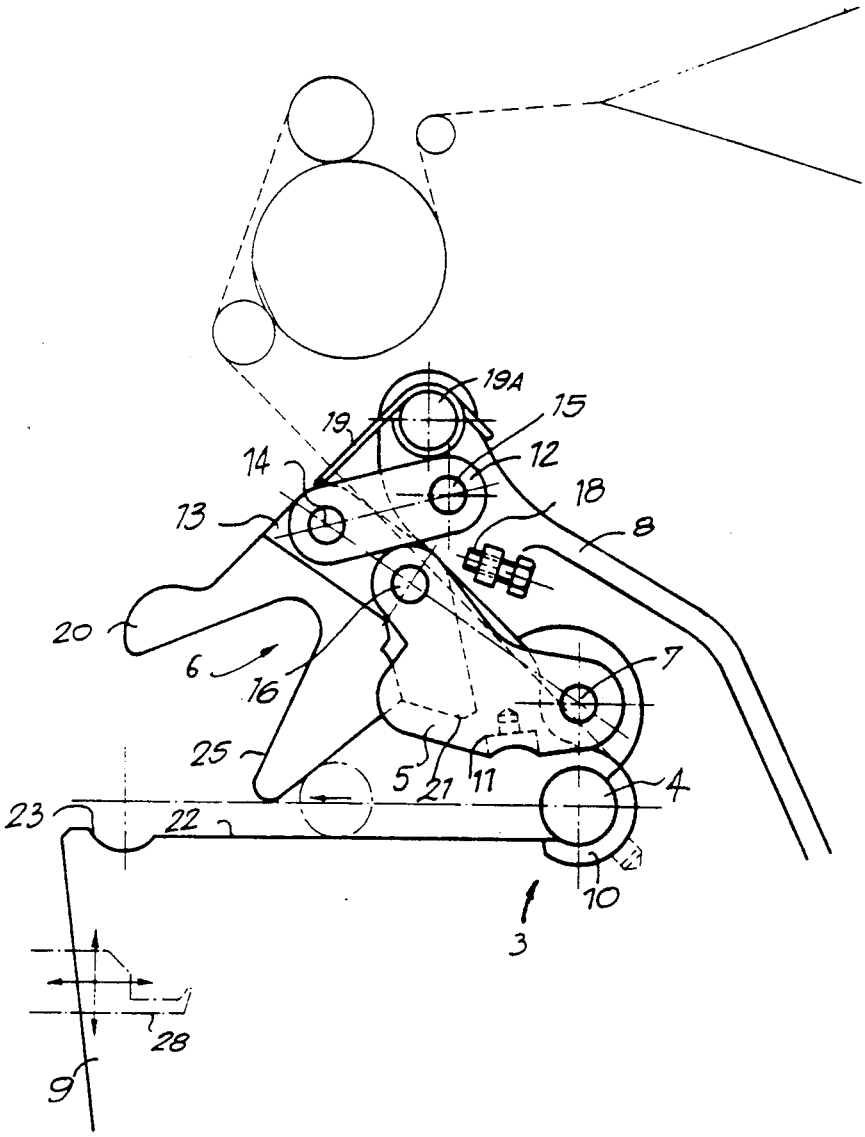
Figure 5:
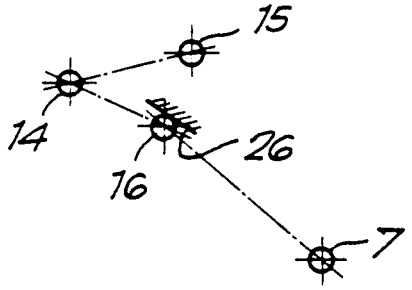
FIG. 5 shows a schematic representation of another special position.

In order to remove the shaft 1 from the support 3, the lock 5 can be opened manually by tilting the handle 20 according to arrow A, such that a situation is created, as shown in FIG. 4, whereby the shaft ends 4 can pass freely underneath the lock 5.

Preferably, the fulcrums 7, 14, 15 and 16, as well as the arms 12 and 13 and the lock 5 are constructed such that when the handle 20 is pulled down completely, the arm 13 and the lock 5 are toggled round the fulcrum 16 until the whole comes in contact with a stop 26, for example formed by the edge of the support 8. As a result, the blocking mechanism 6 remains in a stable deactivated position, as is represented schematically in FIG. 5.

When the shaft 1 is removed from the supports 3, the former is pushed over the supporting plane 22, whereby it makes contact with the above-mentioned cam 25, such that the blocking mechanism 6 is activated and the twin support 3 is closed again.

When the shaft 1 is automatically removed, as indicated in FIG. 2, a pushing mechanism 27 exerts a force F on the part 21 in order to bring the blocking mechanism 6 in its non-blocking position, before the shaft 1 is removed from the supports 3, sliding over the supporting planes 22, by means of suitable movable arms 28 or similar.

In order to be able to work with shaft ends 4 of various thicknesses or to set the play or the prestress of the gripping force of the lock 5 on the shaft end 4, an adjustable eccentric 29 is preferably mounted in the fulcrum 15, so that the fulcrum 15 can be shifted.

The setting of the stop 18 also allows the part 11 of the support 3 to come loose from the shaft end 4, such that the shaft 1 is locked but can still turn.

FIGS. 6 to 10 show a variant whereby the hinged blocking mechanism 6 includes only one arm, particularly in the form of a lever 30.

The lock 5 in this embodiment also includes an arm which can turn round a hinge point 7. The connection between the lever 30 and the lock 5 includes a hinge clutch 31 which provides a well-defined play such that the lever 30 and the lock 5 act on one another by means of a pin slot clutch. The lever 30 can be turned round a fulcrum 32 which is situated fixed to the frame and is charged by means of a spring 34 or similar at the end 33 which is situated opposite the hinge clutch 31, such that the lock 5 is pressed in its locked position, whereby in this position the fulcrum 32, the shaft 1 and the centre of the hinge clutch 31 are almost in one line 35.

The end 33 has a handle 36 and, at its underside, a cam 37, whose aim will become apparent from the description below.

Between the fulcrum 32 and the hinge clutch 31 a stop 38 is provided against which an element 39, such as an arm for removing the shaft 1, can be presented to move the lever 30 against the force of the spring 34.

The lock 5 also has a part 40 which can operate in conjunction with an adjustable stop 41, in order to prevent the movable part 11 from exerting a frictional force on the shaft end 4. The part 40 can also operate in conjunction with a flexibly bendable stop 42, such that when the part 40 is moved past this stop, the lock 5 cannot be moved back by the force of the spring 34.

The supporting plane 22 over which the shaft 1 can be supplied is preferably placed horizontally. It is clear that the above-mentioned elements 39 for supplying and removing shafts 1 are provided with suitable driving means to move these horizontally and vertically, and to take up a shaft 1, such as a cloth roll or a warp beam, particularly as described below.

Figure 6:
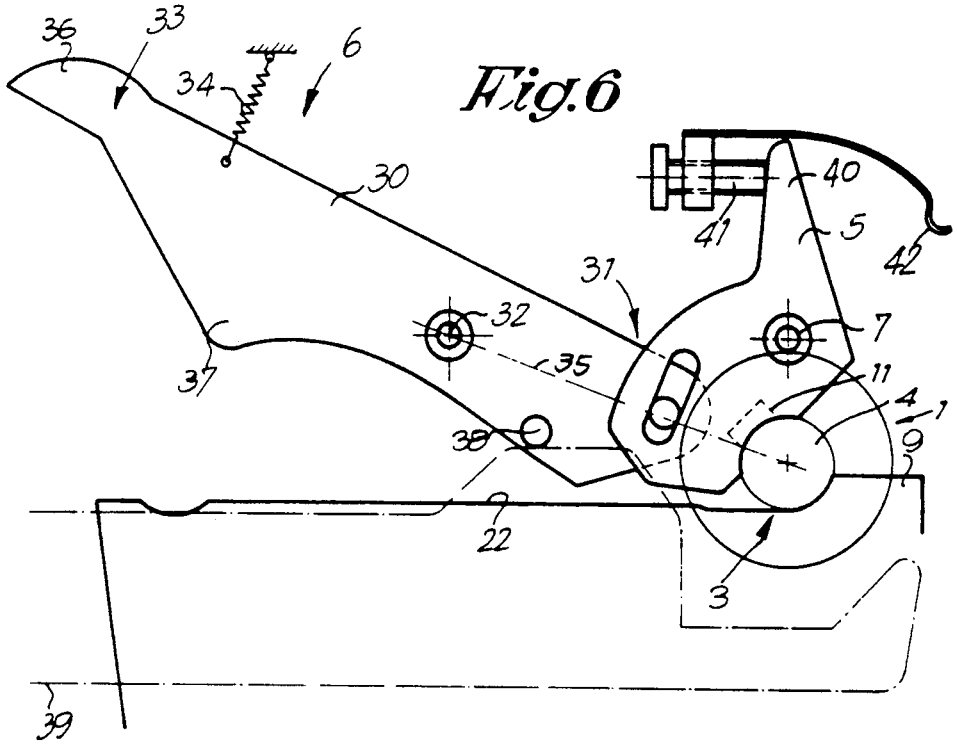

The working of the device according to FIG. 6 can be easily deduced from the FIGS. 6 to 10.

Figure 7:
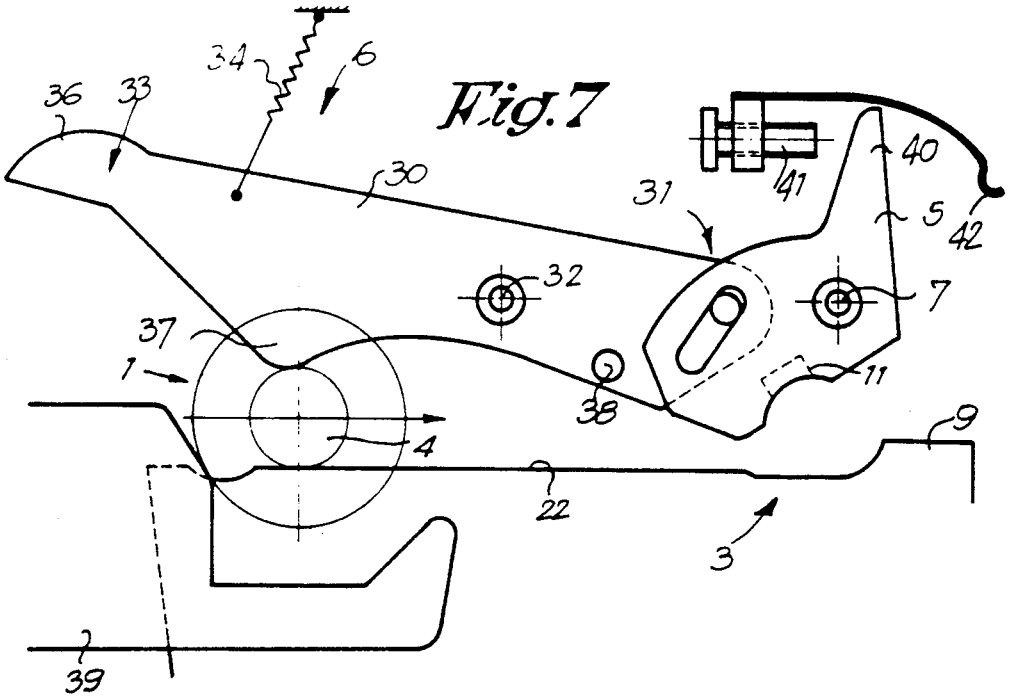

FIG. 7 shows the application of a shaft 1 in the support 3. The shaft 1 is pushed forward over the supporting planes 22, situated underneath the shaft ends 4, by exerting a horizontal force on it by means of the above-mentioned elements 39. The shaft ends 4 slide underneath the lever 30 and the lock 5, whereby the latter are pressed aside conveniently.

Figure 8:
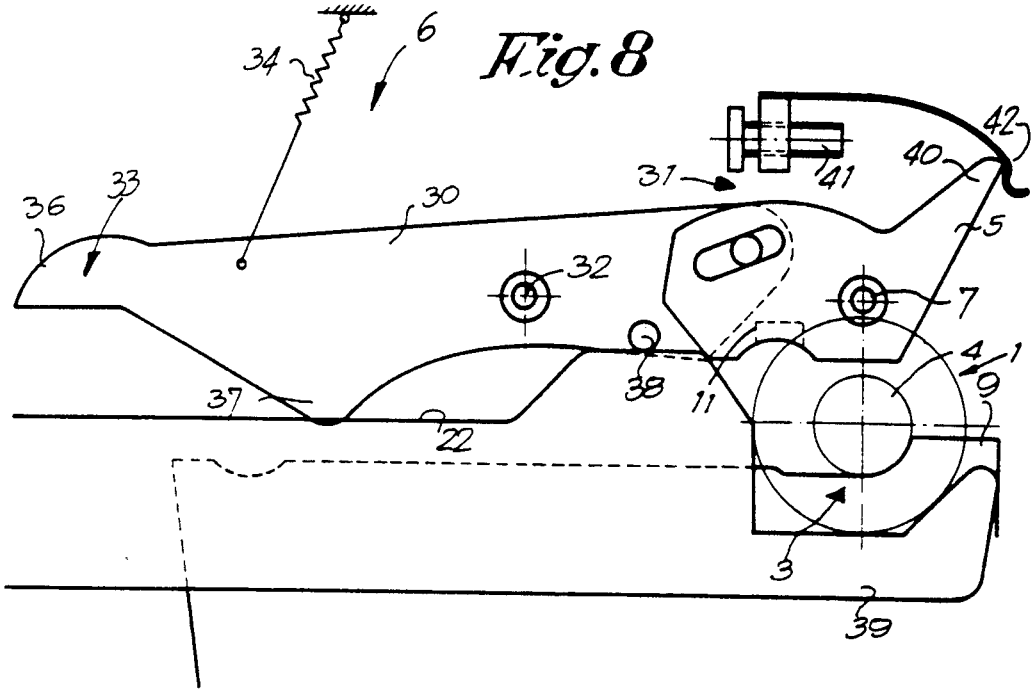

Removing the shaft 1 is done by deblocking the blocking mechanism 6, for example by exerting an upward pressure on the stop 38 by moving the element 39, respectively the elements 39, upward until a position is reached as indicated in FIG. 8. Then the shaft 1 can be pulled out of the support 3 by moving the elements 39 to the left, whereby the shaft ends 4, however, keep resting on the supporting planes 22.

Figure 9:
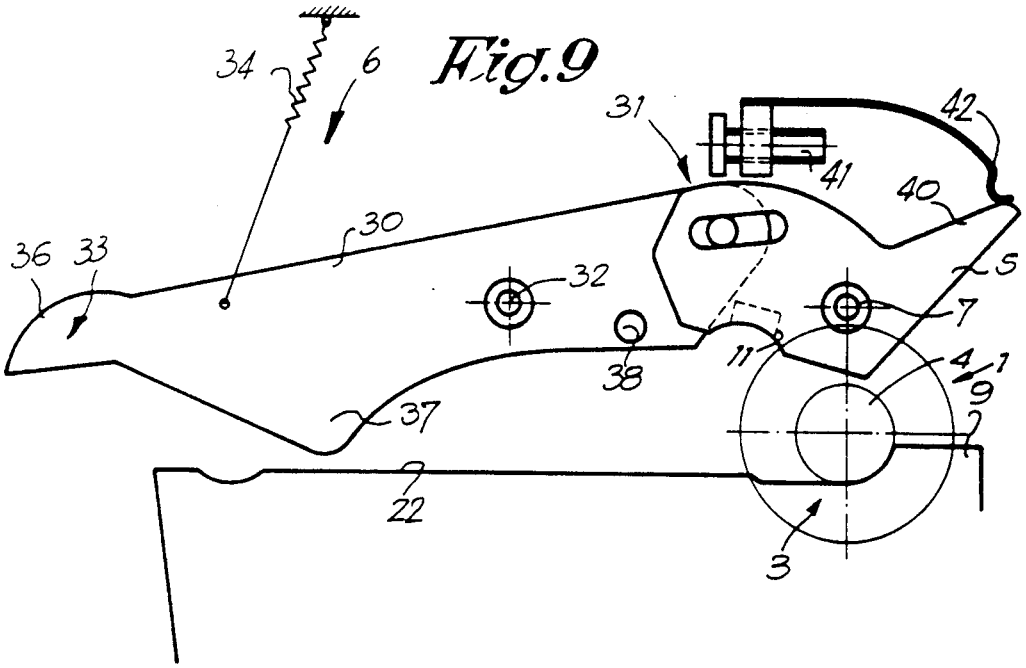

If the shaft 1 is removed manually, i.e. without using the above-mentioned elements 39, the lever 30 is pulled down at the end 33 until a position is reached as shown in FIG. 9, whereby the lock 5 is opened and is held behind the stop 42. Then the shaft 1 can be slid out of the support 3 over the supporting planes 22.

Figure 10:
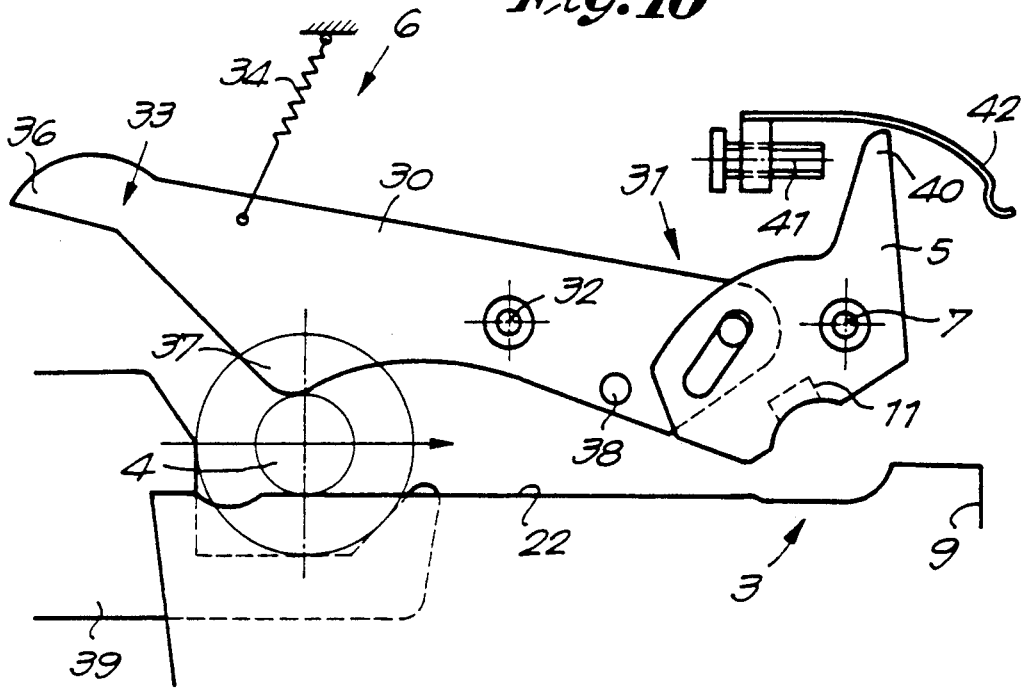
FIGS. 6 to 10 show a variant in various positions.

When the shaft 1 is removed either manually or automatically, the lock 5 is closed again, after the shaft 1 has been removed, as the shaft ends 4 act on the cam, respectively cam 37, and the end 33 is moved up until the spring 34 keeps the whole in a closed position again, as indicated in FIG. 10.

Figure 11:
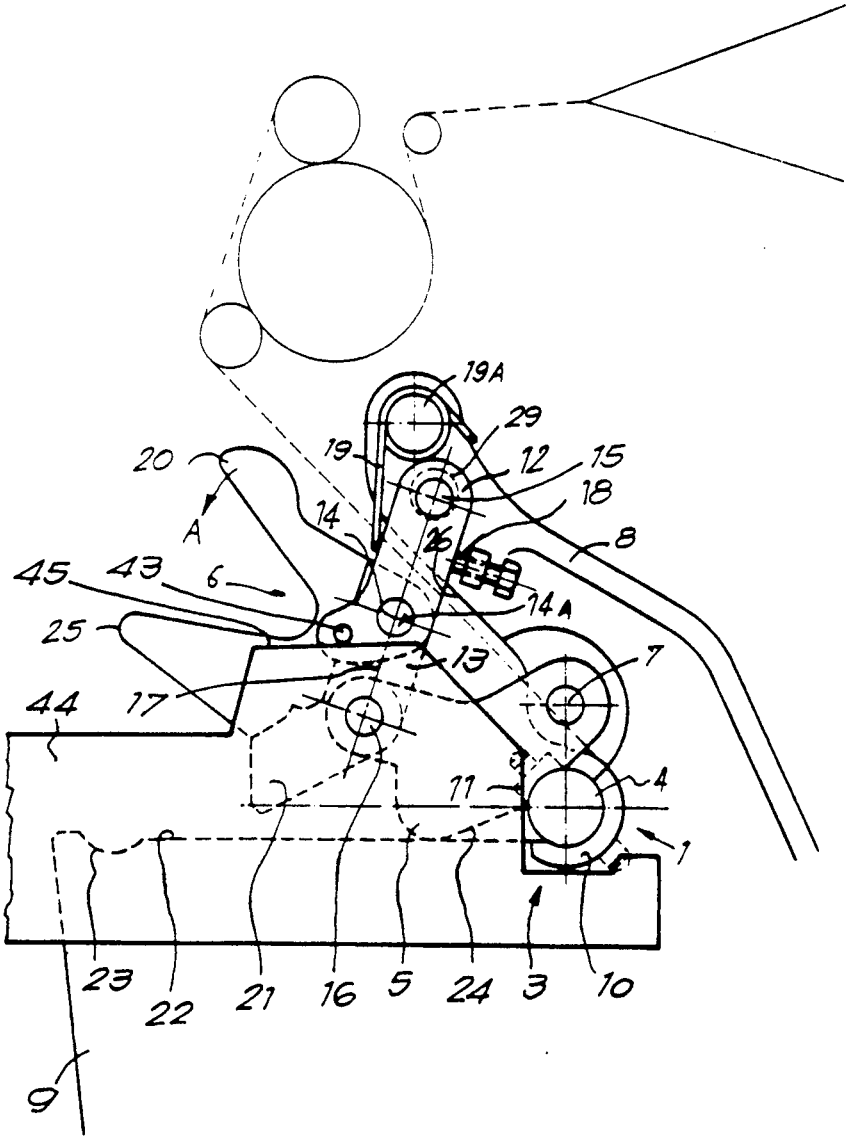
FIG. 11 shows another variant.

FIG. 11 shows a variant whereby on the blocking mechanism 6, particularly on the above-mentioned arm 12, a stop 43 is applied which is situated such that the device is opened when an upward pressure is exerted on stop 43.

This stop 43 allows the device to be opened by a movable element 44 which exerts a pressure on the stop 43. As indicated in FIG. 11, this movable element 44 may include a transport arm in order to remove the shaft 1 from the supports 3, whereby the upper side 45 makes contact with the stop 43 when the transport arm is presented to the shaft 1. The present invention is in no way limited to the embodiments described by way of example and shown in the drawings; on the contrary, such a device can be made in various shapes and dimensions while still remaining within the scope of the invention.

We claim:

1. A device for attaching a shaft having two ends in a frame, comprising:

first and second support means for supporting the shaft at its ends;

a lock member movably connected to the support means for movement between opened and closed positions for securing the shaft to said first support means while allowing the shaft to rotate about its longitudinal axis;

a member movably connected to the lock member;

insertion responsive means for opening the lock member when inserting the shaft into the lock member, said insertion responsive means including said movably connected member, said movably connected member being engaged and moved by said shaft during insertion of said shaft between the support means and the lock member, whereby moving the movably connected member causes the lock member to move between the opened and closed position;

hinged locking means having locked and unlocked positions for securing the lock member in its closed position when said hinged locking means is in its locked position; and pressing means for biasing the hinged locking means into its locked position.

2. A device according to claim 1, wherein the lock member comprises a rotatable arm rotatably supported by a frame (9), and means including said rotatable arm for securing the shaft at one end when the lock member is in its closed position.

3. A device according to claim 2, wherein the hinged locking means comprises:

a hinge clutch (31);

lever means (30) rotatably connected to a fulcrum (32) situated in a fixed position with respect to the frame, said hinged locking means being connected at one end to the lock member by means of the hinge clutch (31); and means for locating a center of the hinge clutch substantially on a line connecting the fulcrum (32) of the lever means and the longitudinal axis of the shaft.

4. A device according to claim 3, further comprising means for toggling the center of the hinge clutch past a line (35) connecting the fulcrum (32) of the lever means and the longitudinal axis of the shaft when the device is in a locked position.

5. A device according to claim 3, wherein the lever means is biased by flexible means (34) for biasing the lock member towards a closed position.

6. A device according to claim 3, wherein the lever means has a motion-limiting stop (38), and wherein the device also has moveable means (39) for cooperating with the lever means, to bring the locking means out of its locking position.

7. A device according to claim 3, further comprising means including a flexibly bendable stop (42) for holding the lock member behind the flexibly bendable stop.

8. A device according to claim 1, wherein said first support means also forms part of said lock member.

9. A device according to claim 1, wherein the hinged locking means comprises first and second arms (12 and 13) which form a toggle mechanism, said first arm being pivotably connected to the frame by a first fulcrum (15), said second arm being pivotably coupled to the first arm by a second fulcrum (14) and pivotably connected to the lock member by a third fulcrum (16), and said three fulcrums being positioned so as to be substantially collinear.

10. A device according to claim 9, further comprising adjustable stop means (18) for limiting displacement of the second fulcrum when the locking means is in the locked position.

11. A device according to claim 9, further comprising pressing means including torsion spring means (19) attached to the frame for biasing the locking means into the locked position.

12. A device according to claim 9, further comprising handle means (20) for opening the lock member, said handle means being connected to the second arm of the locking means essentially crosswise in relation to a line joining the second and third fulcrums.

13. A device according to claim 9, wherein said insertion responsive means comprises means for allowing the hinged locking means to open the lock member, said means for allowing the hinged locking means to open the lock member comprising a second arm of the locking means, said locking means being moved by the shaft when presented to the device.

14. A device according to claim 13, further comprising a supporting plane (22) and means for pushing the shaft along the supporting plane into the first and second support means at its shaft ends.

15. A device according to claim 14, wherein the locking means comprises means including a cam (25) for operating in conjunction with the shaft when the shaft is pushed back over the supporting plane to close and lock the lock member.

16. A device according to claim 14, wherein the locking means comprises means including a cam (37) for operating in conjunction with the shaft when the shaft is pushed back over the supporting plane, in order to close and lock the lock member.

17. A device according to claim 1, wherein the hinged locking means comprises first and second arms (12 and 13) which form a toggle mechanism, said first arm being pivotably connected to the frame by a first fulcrum (15), said second arm being pivotably coupled to the first arm by a second fulcrum (14) and pivotably connected to the lock member by a third fulcrum (16) and, wherein, when the locking means acts to secure the lock member in its closed position, the second fulcrum is not collinear with the first and third fulcrums.

18. A device according to claim 1, wherein said insertion responsive means comprises means for causing the hinged locking means to open the lock member.

19. A device according to claim 18, wherein the means for causing the hinged locking means to open the lock member comprises a toggle mechanism including an arm pivotably connected to said locking means, said arm comprising a handle means by which the hinged locking means opens the lock member.

20. A device according to claim 18, wherein the means for allowing activation of the hinged locking means comprise stop means (43) for opening said lock member by exerting upward pressure on said stop means (43).

21. A device according to claim 18, wherein the means for causing the hinged locking means to open the lock member comprises means (21) on which the shaft can exert pressure before placing the hinged locking means in unlocked position.

* * * * *